US007485027B2

(12) United States Patent
Miller

(10) Patent No.: US 7,485,027 B2
(45) Date of Patent: Feb. 3, 2009

(54) ABRASIVE ENTRAINMENT

(76) Inventor: Donald Stuart Miller, Brookside, Church Walk, Harrold, Bedford, Bedfordshire MK47 7DG (GB)

( * ) Notice: Subject to any disclaimer, the term of this patent is extended or adjusted under 35 U.S.C. 154(b) by 0 days.

(21) Appl. No.: 10/579,698

(22) PCT Filed: Nov. 15, 2004

(86) PCT No.: PCT/GB2004/004796

§ 371 (c)(1),
(2), (4) Date: Mar. 19, 2007

(87) PCT Pub. No.: WO2005/051598

PCT Pub. Date: Jun. 9, 2005

(65) Prior Publication Data

US 2007/0155289 A1 Jul. 5, 2007

(30) Foreign Application Priority Data

Nov. 19, 2003 (GB) ..... 0326894.3
Jan. 31, 2004 (GB) ..... 0402214.1

(51) Int. Cl.
*B24B 1/00* (2006.01)
*B24C 3/00* (2006.01)

(52) U.S. Cl. ..... 451/38; 451/40; 451/75

(58) Field of Classification Search ..... 451/36–40, 451/72–102

See application file for complete search history.

(56) References Cited

U.S. PATENT DOCUMENTS 4,555,872 A * 12/1985 Yie ..... 451/40
4,648,215 A * 3/1987 Hashish et al. ..... 451/40
5,018,670 A * 5/1991 Chalmers ..... 239/433
5,456,629 A * 10/1995 Bingham ..... 451/39
5,733,174 A * 3/1998 Bingham et al. ..... 451/39
6,425,805 B1 * 7/2002 Massa et al. ..... 451/40
2003/0029934 A1 2/2003 Hashish et al.

FOREIGN PATENT DOCUMENTS

DE 26 19 880 A 11/1977
EP 1036633 9/2000
JP 2000075095 3/2000

OTHER PUBLICATIONS

International Search Report based on PCT/GB2004/004796.

* cited by examiner

*Primary Examiner*—Dung Van Nguyen
(74) *Attorney, Agent, or Firm*—Heslin Rothenberg Farley & Mesiti P.C.; Victor A. Cardona

(57) ABSTRACT

A method for generating a high-velocity cutting jet comprises forming a high velocity jet of a liquid such as water, forming a suspension of an abrasive such as garnet in a carrier gas containing a condensable vapour such as superheated steam, and entraining the abrasive suspension into the liquid jet so that the vapour condenses, producing a cutting jet of a liquid/abrasive mixture. A cutting head of apparatus for generating the cutting jet has a chamber into which the abrasive suspension is passed. The liquid jet traverses this chamber, entraining the suspension, and passes into a tapering transition region and a bore of a nozzle. Kinetic energy is transferred from the liquid jet to the abrasive as they pass trough the chamber and the nozzle. Condensation of the vapour ensures that the cutting jet leaves the nozzle at close to ambient pressure, reducing the diameter of the cutting jet compared to conventional abrasive-in-air systems, so as to increase the energy density of the abrasive.

7 Claims, 2 Drawing Sheets

ABRASIVE ENTRAINMENT

CROSS REFERENCE TO RELATED APPLICATIONS

This application is a national stage of PCT International Application No. PCT/GB2004/004796, filed on 15 Nov. 2004, and published in English on 9 Jun. 2005, as WO 2005/051598 A1, and claims priority to GB 0326894.3, filed 19 Nov. 2003, and GB 0402214.1, filed 31 Jan. 2004, the entire disclosures of which are incorporated herein by reference.

The present invention relates to the entrainment of abrasive particle/gas mixtures by high speed jets of liquid to produce abrasive cutting jets. More particularly, but not exclusively, the abrasive is a material such as garnet or aluminium oxide, the liquid is water, and the entrainment takes place within a nozzle of an abrasive waterjet cutting system.

Increasingly effective abrasive waterjet systems are needed to meet market demands for faster cutting, greater cut surface area generation per kilogram of abrasive, and the machining of finer features by the generation of smaller diameter jets.

Abrasive-in-air entrainment is the established method of generating abrasive waterjet for precision machining. Water at ultra high pressures, typically 2500 to 4000 bar, is passed through an orifice in a cutting head to generate a jet moving at over 700 m/s. The water jet traverses a chamber and enters a ceramic nozzle with a bore that is aligned along the axis of the waterjet orifice. The abrasive is supplied as a particulate material suspended in a flow of air. The waterjet entrains this air at close to atmospheric pressure, conveying abrasive particles into the chamber and thence into the nozzle bore. Within the nozzle, kinetic energy is transferred from the water jet to the abrasive particles. A flow of mixed abrasive/water/air leaves the nozzle as a focused cutting jet.

The overriding advantage of the abrasive-in-air entrainment method is that the abrasive particles are handled at close to atmospheric pressures. The disadvantages are:

1. For the same water pressures and water and abrasive flow rates, jet diameters are 2.5 to 3.5 times those of jets formed by the alternative method of passing suspensions of abrasive particles in water through a nozzle; as a result, 2.5 to 3.5 times the amount of material has to be removed to produce each cut.
2. Kinetic energy transfer from waterjets to abrasive particles is only 60 percent or so of that transferred by accelerating abrasive particles in pressurised water.
3. Approximately 80% by weight or so of the abrasive particles suffer degradation during passage through a nozzle, compared to about 20% by weight when pressurised suspensions of particles in water are accelerated within nozzles. Such particle break-up results in a reduction in work piece material cutting rates and greater cut edge taper.

New methods of generating abrasive waterjets are hence needed that retain the advantage of handling abrasive at close to atmospheric pressure whilst generating smaller diameter jets for given water pressures and water and abrasive flow rates, and having improved kinetic energy transfer and reduced particle break-up.

Air occupies about 90 percent by volume of the nozzle bore in the abrasive-in-air entrainment method and plays a major role in accelerating abrasive particles. Air is repeatedly re-energised within a nozzle bore by drag forces from the waterjet, from droplets ejected by the waterjet and from slugs of water as the waterjet breaks up. The energy transferred to the air is then passed on to the abrasive particles through drag forces. The transfer of kinetic energy from the air to the abrasive particles is proportional to the air density and to the square of the velocity difference between the particles and the surrounding air. It is, therefore, desirable to operate with high air densities and velocities.

Higher air densities in nozzle bores require higher static pressures. However, static pressures above ambient at nozzle outlets are undesirable because they cause jets to spread radially from the outlet and this degrades the coherence of the jets and the quality of the cuts. At nozzle outlets, jet velocities are well above the speed of sound in air, so information cannot propagate from their surroundings into the nozzles. This means that pressures in nozzle bores are unlikely to be in equilibrium with atmospheric pressure, and so shock wave systems form close to, at or external to nozzle outlets. Normal shock waves are predicted to occur inside a nozzle if the pressure are subatmospheric, and rarefaction waves will occur outside the nozzle if the static pressure in the nozzle is above atmospheric pressure. Because of the very high kinetic energies of the water and abrasive particles, relative to air, the form of the resulting shock waves will be complex and cannot be determined with current technology.

Air compression in a nozzle inlet leads to above-ambient pressures at the nozzle outlet. Whether air compression occurs, and its magnitude, depends on the quality of a waterjet; on the distance between a waterjet orifice and the nozzle inlet; on the ratio of the nozzle bore diameter to the waterjet orifice diameter; on the alignment of the orifice and the nozzle; and on the design of the nozzle inlet. Even modest air compression, relative to the compressive capabilities of waterjets, can result in excessive pressures in the abrasive/water/air flows leaving the nozzle, leading to an increased spread of the jet leaving the nozzle, with consequential adverse effects on cutting performance, including cut edge rounding, edge taper and frosting of work piece surfaces along cut edges.

One of the effects of supersonic air velocities in nozzle bores is air compression in contracting bore sections. Air velocities before and after a bore contraction will remain roughly the same, due to the drag effects of water and abrasive. Therefore, static air pressure must rise across a bore contraction in order to compress the air so that it may flow through a smaller cross-section. Such a pressure rise is an undesirable consequence when a bore area is reduced prior to a nozzle outlet in order to form a smaller diameter cutting jet having a higher particle energy density.

It is hence an object of the present invention to provide a method for forming a cutting jet of liquid and abrasive that obviates the above problems and provides the above benefits. It is a further object of the present invention to provide apparatus for forming a cutting jet that obviates the above problems and provides the above benefits.

According to a first aspect of the present invention there is provided a method for generating a high-velocity cutting jet, comprising the steps of forming a high-velocity jet of a liquid, forming a suspension of an abrasive material in a carrier gas comprising a condensable vapour, and so entraining the suspension of abrasive material into the liquid jet that at least part of the vapour condenses to produce a jet of a mixture comprising abrasive material and liquid.

Preferably, the suspension of abrasive material in carrier gas is provided at above ambient pressure.

Advantageously, the condensation of the vapour produces a pressure close to ambient pressure.

Optionally, substantially all of the vapour in the carrier gas may condense.

The carrier gas may also comprise a gas that is not condensable when entrained into the liquid jet, such as air.

This will produce a jet of a mixture comprising abrasive material, liquid and non-condensable gas.

Preferably, the vapour is condensable to form said liquid.

Preferably, the liquid comprises water.

Advantageously, the condensable vapour comprises steam.

Optionally, the condensable vapour comprises dry steam.

The condensable vapour may comprise superheated steam.

Preferably, the liquid jet is formed by releasing liquid under pressure through orifice means.

Advantageously, the entrainment step is performed at least partially within a restricted bore of a nozzle means.

Optionally, the entrainment step is performed substantially within said bore.

The entrainment step may be performed at least partially within chamber means traversed by the liquid jet before entering said nozzle means.

The method may comprise the further step of introducing condensable vapour and/or non-condensable gas into the liquid jet subsequently to the entrainment of the abrasive suspension.

The method preferably comprises the further steps of directing the jet of abrasive material/liquid mixture on to a workpiece to be cut, and moving the jet and the workpiece, one relative to the other, so as to cut the workpiece as desired.

The abrasive material preferably comprises a particulate abrasive material.

The abrasive material advantageously comprises garnet, olivine or aluminium oxide.

According to a second aspect of the present invention, there is provided apparatus for generating a high-velocity cutting jet, comprising means to form a high-velocity jet of liquid, means to form a suspension of an abrasive material in a carrier gas comprising a condensable vapour, and means to entrain said suspension into the jet of liquid so that at least part of the vapour condenses to produce a jet of a mixture comprising abrasive material and liquid.

The liquid preferably comprises water.

Advantageously, the condensable vapour comprises steam.

Optionally, the condensable vapour may comprise dry steam.

The carrier gas may also comprise a gas that is not condensable when entrained into the liquid jet, such as air.

This will produce a jet of a mixture comprising abrasive material, liquid and non-condensable gas.

Preferably, the liquid jet forming means comprises a source of liquid under pressure so connected to restricted orifice means that the liquid is projected therefrom as a high-velocity jet.

The apparatus may be provided with nozzle means having an elongate bore extending between an inlet and outlet thereof and so substantially aligned with the liquid jet projected from the orifice means that said jet may pass therethrough.

The nozzle means may comprise a substantially parallel-sided bore.

The nozzle means may alternatively comprise a bore tapering between the inlet and the outlet of the nozzle means.

The nozzle means may comprise a plurality of nozzle sections, a bore of each said nozzle section being substantially aligned with the liquid jet.

A first said nozzle section adjacent the nozzle inlet may have a bore diameter greater than that of a second said nozzle section adjacent the first.

The nozzle means may comprise a third said nozzle section, adjacent to the second, and having a bore diameter less than that of the second nozzle section.

Each said nozzle section may comprise a frustoconical inlet portion coaxially connected to the bore thereof.

The diameter of the nozzle bore at the nozzle outlet is preferably between one and a half and three times the diameter of the orifice means.

Means may be provided to introduce one or more flows of said condensable vapour and/or non-condensable gas into the nozzle means intermediate of the inlet and outlet thereof.

The nozzle means may comprise a very hard material, having a Mohs hardness of at least 9, such as tungsten carbide or polycrystalline diamond.

Preferably, the apparatus is provided with chamber means disposed between the orifice means and the nozzle means, which is traversed by the liquid jet and into which the suspension of abrasive material in carrier gas is passed so as to be entrained into the liquid jet.

A frustoconical transition zone may be provided, connecting the chamber means to the inlet of the nozzle means.

Means may be provided to introduce one or more supplementary flows of said condensable vapour and/or non-condensable gas into the chamber means.

The suspension may thus be entrained into the liquid jet both within the chamber means and within the nozzle means.

The chamber means may comprise a material having a low thermal conductivity or may be provided with a lining thereof.

Preferably, the means to form a suspension of abrasive material in a carrier gas comprises means to generate a flow of said condensable vapour, a supply of abrasive material and means to meter the abrasive material into said flow.

It may also comprise means to pass a flow of said condensable vapour through the supply of abrasive material.

The means to form a suspension of abrasive material may include ejector means adapted to induce abrasive flow from the supply through the metering means.

Means may be provided to introduce said non-condensable gas into the flow of condensable vapour.

Advantageously, said vapour generating means comprises a supply of liquid and means to heat said liquid above its boiling point.

Said heating means may be powered by electricity or gas fuel.

Said heating means may comprise at least one positive temperature coefficient heater.

Preferably, the apparatus is provided with means to direct the jet of mixed abrasive material, liquid and optionally gas on to a workpiece so as to form a cut therethrough.

Embodiments of the present invention will now be more particularly described by way of example and with reference to the accompanying drawings, in which.

Figure 1:
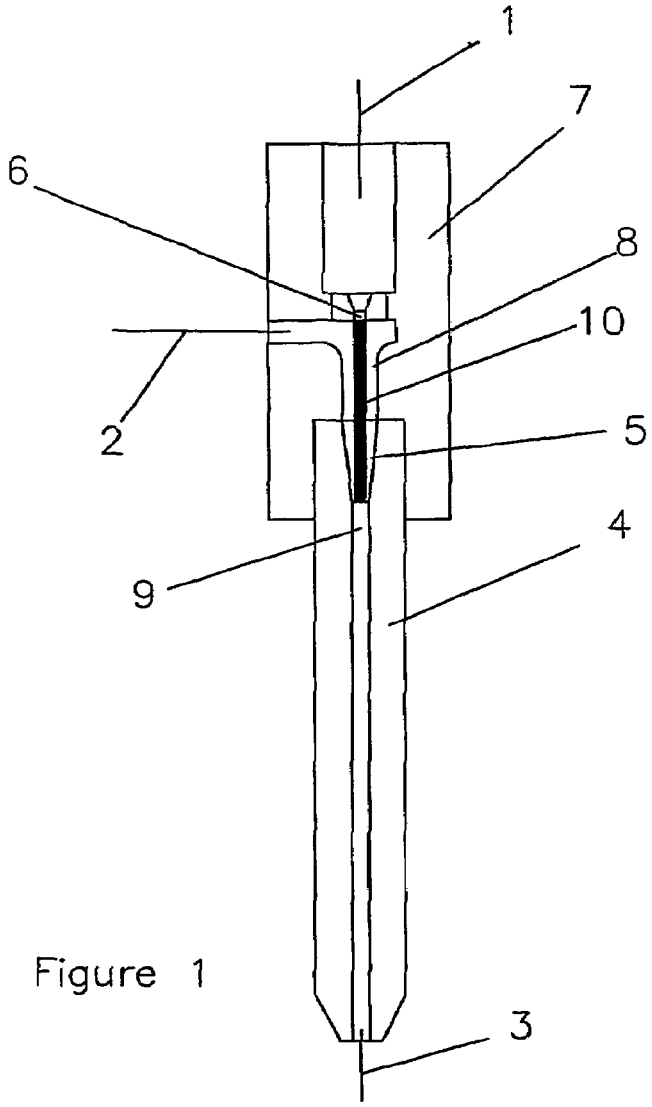
FIG. 1 shows a schematic diagram of a first cutting head embodying the present invention.

Referring now to the Figures and to FIG. 1 in particular, pressurised water enters a cutting head 7 through a first conduit 1. The water passes through a restrictor 6 to form a jet 10 that traverses a chamber 8 and passes into a nozzle 4. Steam or steam/air mixtures carrying abrasive particles enter the cutting head 7 through a second conduit 2 leading into the chamber 8, which connects via a transition region 5 in the nozzle 4 to a bore 9 of the nozzle 4. Entrainment and initial axial acceleration of the abrasive particles takes place in the chamber 8 and the transition region 5, with most of the energy exchange between water and abrasive occurring in the nozzle bore 9 along with steam condensation. An abrasive/water/steam/air mixture leaves the bore 9 of the nozzle 4 as a cutting jet 3. Typically the ratio of diameters of the nozzle bore 9 to the restrictor 6 is between two to one and three to one. An outlet diameter of the nozzle 9 may be smaller than its inlet diameter.

The nozzle 4 will usually be manufactured from a composite material containing tungsten carbide or polycrystalline diamond, or from a base material having a diamond or other hard coating within the bore 9.

The second conduit 2 and the chamber 8 may be lined with or constructed from low thermal conductivity, abrasive resistant materials. One or more additional connections to the chamber 8 may allow steam to flow through and out of the chamber 8 to pre-warm or maintain chamber 8 temperatures, and to allow higher steam flows in the second conduit 2 to convey particles to the chamber 8 when the nozzle bore 9 diameter is less than 300 μm or so.

Figure 2:
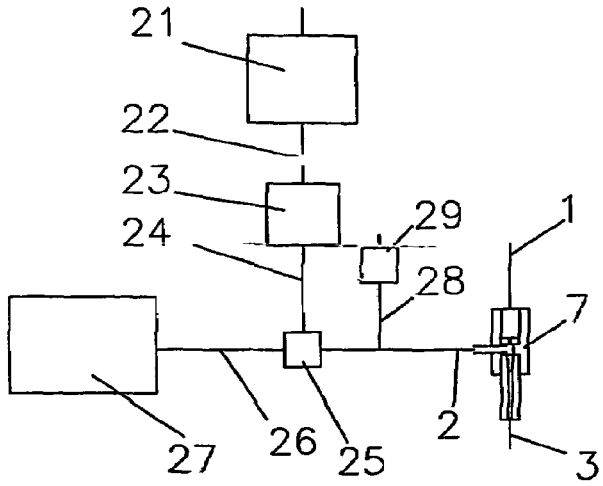
FIG. 2 shows a flow circuit for feeding abrasive to a cutting head embodying the present invention.

FIG. 2 shows a flow circuit for feeding abrasive to cutting heads such as shown in FIG. 1.

Abrasive particles from a vessel 21 flow via a third conduit 22, a first metering device 23 and a fourth conduit 24 to a junction 25 at which the particles are mixed with steam flowing from a steam generator 27 along a fifth conduit 26 to the junction 25. From the junction 25, the abrasive is carried by this steam flow through the second conduit 2 and into the cutting head 7. Abrasive in the vessel 21 may be heated to prevent condensation on the particles whilst they are flowing to the cutting head 7, and the abrasive particles in the vessel 21 may be blanketed in steam to prevent air reaching the cutting head 7. The driving steam may optionally be passed through the abrasive feed vessel 21 to assist in metering abrasive out of the vessel. Indeed, the steam generator 27 may be an integral part of the abrasive vessel 21. A connection 28 to the second conduit 2 allows air to be fed to the cutting head 7 through a second metering device 29.

The junction 25 may take the form of an ejector that induces abrasive flow through the first metering device 23. The junction 25 may form part of the second conduit (or cutting head inlet) 2 of FIG. 1, in which case abrasive flow through the fourth conduit 24 may be metered by an established powder metering means.

Electric heaters with positive temperature coefficients may be used to limit the temperatures and pressures produced from the steam generator 27. Typical steam conditions are 4 bar and 160° C., although higher or lower pressures are possible. Based on the equivalent of 1% by weight of water flowing as steam, a power input for steam generation of 1 kW per liter/minute of water flow through the restrictor 6 is appropriate. Higher power inputs may be appropriate for warming up the flow circuit, prior to starting abrasive flow, and to enable rapid steam generation. The steam may be superheated within the steam generator 27 or after leaving the generator.

Figure 3:
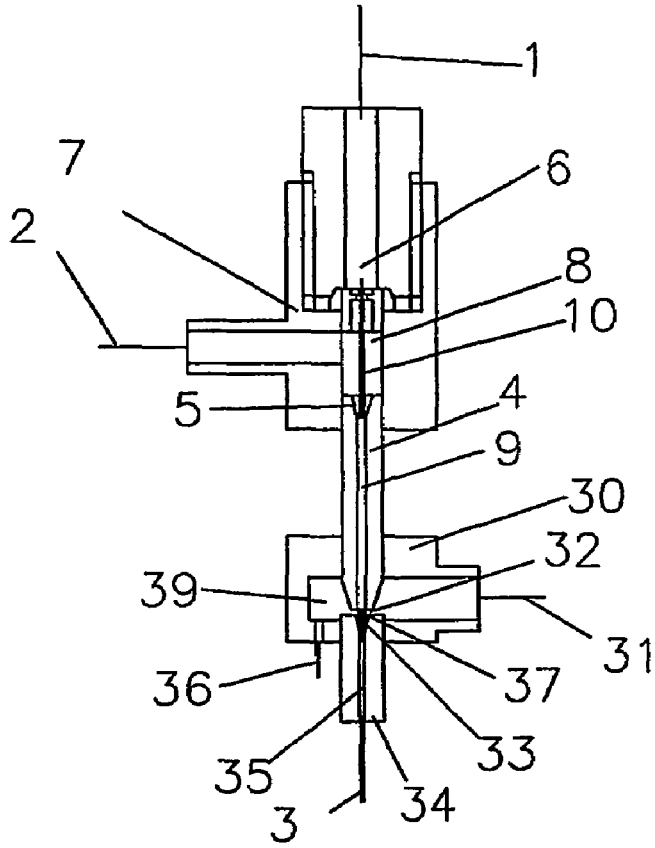
FIGS. 3 and 4 show alternative cutting heads also embodying the present invention.

FIG. 3 shows a cutting head 7 similar to that of FIG. 1, provided with an assembly 30 that comprises a focusing nozzle 34 with a focusing bore 35 aligned with the bore 9 of the nozzle 4 so as to receive a flow 33 leaving the nozzle 4. The bore 35 of the focusing nozzle 34 will usually be smaller in diameter than the bore 9 of the nozzle 4, though its inlet 37 will have a diameter larger than that of the nozzle bore 9. The assembly 30 has an inlet chamber 39 with an inlet 31 for passing steam and/or air flow through an annular plenum 32 between the outlet of the nozzle 4 and the inlet 37 of the focusing nozzle 34, and into the bore 35 of the focusing nozzle 34. Energy exchange from water to abrasive continues within the bore 35, accompanied by steam condensation, until the combined flows exit the focusing tube 34 as a cutting jet 3.

Figure 4:
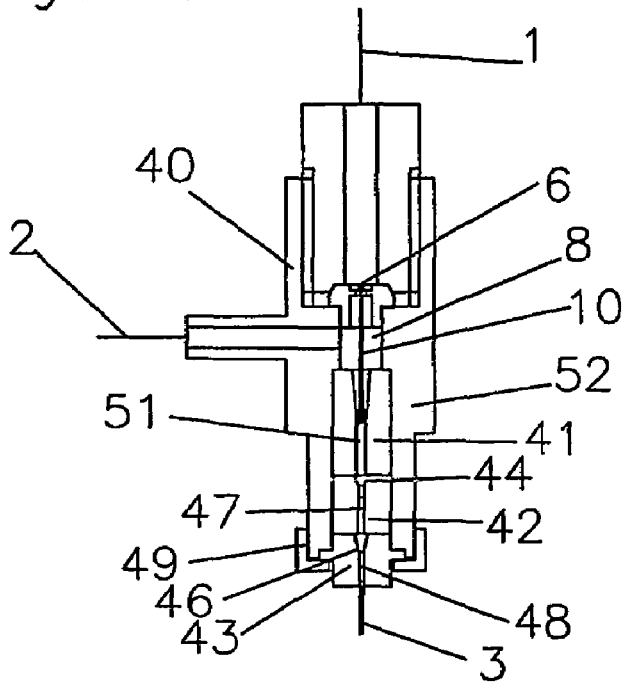

FIG. 4 shows a second cutting head 40 that has an initial nozzle 41 and two focusing nozzles 42 and 43 retained to a body 52 of the cutting head 40 by a gland nut 49. A first focusing nozzle 42 has an inlet 44 with a diameter greater than the diameter of a bore 51 of the initial nozzle 41, whilst a second focusing nozzle 42 has an inlet 46 with a diameter greater than the diameter of its bore 48. The ratio of successive bore diameters 51 to 47 and 47 to 48 is typically in the range between 1.1 to 1 and 1.3 to 1.

The cutting head 40 of FIG. 4 may be modified so that there is a gap between the initial nozzle 41 and the second focussing nozzle 43, and/or between the two focusing nozzles 42 and 43, with connections and other arrangements for introducing additional steam and/or air flows as described for the cutting head of FIG. 3.

The method of generating abrasive waterjets described herein involves conveying abrasive particles into a nozzle using steam (or a combination of steam and air) and condensing all or part of the steam within the nozzle. By condensing steam within the nozzle, higher pressures can be used in the inlet to the nozzle whilst avoiding above-atmospheric pressures at the nozzle outlet.

A further benefit of using steam is the higher speed of sound therein, over 450 m/s compared to that in air of around 330 m/s. At the start of a nozzle bore, the aim is to have sonic velocities. Assuming sonic velocity at the start of a nozzle bore, steam drag forces on particles can be more than double the drag forces produced with air of the same density.

At near-atmospheric pressures steam condenses to water having one thousandth or so of its volume. The equivalent of about 1% by weight of the overall water flow is needed in the form of steam to convey and accelerate abrasive particles in the systems described. Waterjets can condense 1% by weight of steam while experiencing a water temperature rise of less than 10° C., which should be of no real significance.

The environment within a nozzle bore leads to rapid condensing of steam. If required, admitting air along with the steam would allow the pressure within the bore to be maintained above water vapour pressure.

Condensing the abrasive particle carrier fluid allows the use of nozzles with tapered bores and nozzles comprising two or more sections, the second and any subsequent sections having contracting inlets and a smaller bore diameter than the preceding section. The provision of an annular space between such sections allows steam and/or air to be injected or entrained into the second and any subsequent nozzle section. The introduction of steam and/or air between these nozzle sections helps to maintain static pressures within the nozzle bores that would otherwise fall towards vapour pressure, due to the effects of steam condensation. By suitable shaping of such gaps between nozzle sections, incoming steam and/or air can also act to reduce undesirable particle impacts within the inlet to a downstream nozzle section, as well as aiding in transferring kinetic energy to abrasive particles.

Steam condensation is also a powerful mechanism for generating a fluid flow to carry abrasive particles to a cutting head and to bring particles into contact with a waterjet. Small diameter waterjets, which could not entrain sufficient air to convey abrasive effectively into their cutting heads, can condense sufficient steam to convey abrasive either directly in the steam flow or by inducing airflows carrying abrasive particles. Cutting heads that utilise such abrasive-in-steam entrainment can operate with jet diameters below 200 μm, compared to a minimum of 500 μm or so for abrasive-in-air entrainment cutting heads (unless additional suction means are provided).

The best-performing abrasive-in-air entrainment nozzles have lives of up to 100 hours before wear causes outlet diameters to become unacceptably oversize. Barrelling of the bore starts just downstream of the nozzle inlet and a wear front then propagates down the bore. Second and subsequent zones of barrelling may also form near the nozzle inlet and propagate down the bore. When the first wear front reaches the nozzle outlet, the nozzle will normally go out of specification and need to be replaced. Nozzle outlet diameters tend to grow linearly with time until the arrival of the first wear front leads to a sudden increase.

By the half-life of a nozzle, the cross-sectional area of its bore near the nozzle inlet will typically be double the original cross-sectional area of the bore. As the bore grows, the conditions for transferring energy from the waterjet to abrasive particles deteriorate, since particles close to the bore walls are less likely to be energised by fast-moving water droplets and slugs. Some of the adverse effects of bore wear on cutting performance can be mitigated in the systems described above by increasing the steam flow as nozzles wear. Worn nozzles will have divergent sections in which steam expands at supersonic velocities, maintaining high drag forces on particles. Because the speed of sound in steam is of the order of 450 m/s, energy dissipating shock waves are less likely to form in regions of decreasing bore diameter than is the case with airflows, in which the speed of sound is around 330 m/s.

It is desirable to subject particles to as steady accelerating forces as possible, in order to reduce particle degradation caused by particles violently impacting with nozzle bores, and by collisions between particles having large velocity differences. The most intense interactions occur at the transition from a nozzle inlet to a nozzle bore, a region where particles are relatively crowded together since they have low axial velocities. In this region of an abrasive-in-air entrainment nozzle, air velocities increase from low sub-sonic to sonic over a distance equivalent to 2 bore diameters or so. At the same time, the particles are brought into intimate contact with a waterjet travelling at over twice the speed of sound. Violent particle/particle, particle/waterjet and particle/nozzle wall interactions occur in this region. It is therefore desirable to extend the length of this transition region further into the bore so as to reduce velocity gradients. However, this results in inlet shapes that greatly increase air entrainment and air compression, with consequential above-atmospheric pressures at nozzle outlets, and deterioration in cutting performance. Using steam or steam/air mixtures as the particle carrier fluid allows more gradual transitions to be used between nozzle inlets and bores, obviating the problems described.

The invention claimed is:

1. A method for generating a high-velocity cutting jet comprises the steps of forming a high-velocity jet of liquid water, forming a suspension of an abrasive material in a carrier gas comprising steam, and so entraining the suspension of abrasive material into the liquid water jet that at least part of the steam condenses to produce a jet of a mixture comprising abrasive material and liquid water.

2. A method as claimed in claim 1, wherein the suspension of abrasive material in carrier gas is provided at above ambient pressure.

3. A method as claimed in claim 1, wherein said condensation of the steam produces a pressure close to ambient pressure.

4. A method as claimed in claim 1, wherein the carrier gas also comprises a gas that is not condensable when entrained into the liquid jet.

5. A method as claimed in claim 1, wherein the entrainment step is performed at least partially within a restricted bore of a nozzle means.

6. A method as claimed in claim 5, wherein the entrainment step performed at least partially within chamber means traversed by the liquid jet before entering said nozzle means.

7. A method as claimed in claim 1, comprising the further step of introducing at least one of condensable vapour and non-condensable gas into the liquid jet subsequently to the entrainment of the abrasive suspension.

* * * * *